United States Patent [19]

Blankenship

[11] Patent Number: 4,801,116

[45] Date of Patent: Jan. 31, 1989

[54] MERCHANDISE HANGER ASSEMBLY

[75] Inventor: David J. Blankenship, Winona, Minn.

[73] Assignee: Peerless Chain Company, Winona, Minn.

[21] Appl. No.: 79,808

[22] Filed: Jul. 30, 1987

[51] Int. Cl.[4] ..... E04G 3/00

[52] U.S. Cl. ..... 248/220.4; 40/661; 211/59.1

[58] Field of Search ..... 248/220.3, 220.4, 221.1, 248/221.2; 211/57.1, 59.1, 54.1; 40/19.5, 16.4, 10 R

[56] References Cited

U.S. PATENT DOCUMENTS

| | | | |
|---|---|---|---|
| D. 237,142 | 10/1975 | Barnes . | |
| D. 249,460 | 9/1978 | Bleed . | |
| D. 249,461 | 9/1978 | Swinehart et al. . | |
| D. 272,414 | 1/1984 | Barnes . | |
| 1,033,915 | 6/1912 | McDonald . | |
| 2,268,493 | 12/1941 | O'Brien | 219/91.23 |
| 2,319,455 | 5/1943 | Hardman | 219/91.23 X |
| 2,830,168 | 4/1958 | Taylor | 219/91.23 |
| 2,987,286 | 6/1961 | Alling . | |
| 3,198,469 | 8/1965 | Callanan . | |
| 3,245,547 | 4/1966 | Felkay . | |
| 3,275,272 | 9/1966 | Kirk . | |
| 3,289,993 | 12/1966 | Thalenfeld . | |
| 3,374,898 | 3/1968 | Karmin . | |
| 3,409,260 | 11/1968 | Bleed . | |
| 3,442,396 | 5/1969 | Cass . | |
| 3,452,954 | 7/1969 | Lucietto et al. . | |
| 3,645,485 | 2/1972 | Gold . | |
| 3,677,415 | 7/1972 | Radek . | |
| 3,711,048 | 1/1973 | Thalenfeld . | |
| 3,724,792 | 4/1973 | Thalenfeld . | |
| 3,815,198 | 6/1974 | Thalenfeld . | |
| 3,897,926 | 8/1975 | Silver . | |
| 3,912,084 | 10/1975 | Valiulis . | |
| 3,976,201 | 8/1976 | Hodgson et al. . | |
| 3,986,613 | 10/1976 | Mayer | 211/57.1 |
| 4,026,508 | 5/1977 | Ziegler . | |
| 4,027,799 | 6/1977 | Stucker . | |
| 4,033,531 | 7/1977 | Levine | 248/558 |
| 4,286,764 | 9/1981 | Pfeifer . | |
| 4,319,730 | 3/1982 | Thalenfeld . | |
| 4,319,731 | 3/1982 | Pfeifer | 248/220.4 X |
| 4,349,975 | 9/1982 | Chubb | 40/10 D X |

(List continued on next page.)

FOREIGN PATENT DOCUMENTS

| | | |
|---|---|---|
| 963877 | 3/1973 | Canada . |
| 2447032 | 10/1974 | Fed. Rep. of Germany . |
| 1483450 | 8/1977 | United Kingdom . |

*Primary Examiner*—J. Franklin Foss

*Attorney, Agent, or Firm*—Merchant, Gould, Smith, Edell, Welter & Schmidt

[57] ABSTRACT

A merchandise hanger assembly is provided for attachment to an upright, apertured merchandise display panel. The merchandise hanger assembly comprises a base portion and a merchandise display hanger. The base portion includes an integrally molded, plastic body having recesses for engaging the hanger, and rearwardly and upwardly projecting L-shaped lugs for mounting on the apertured merchandise display panel. The merchandise display hanger includes upper and lower elements being spaced apart and having inner ends, and a cross bar member being located on a top side of the upper element and extending transversely thereof. The upper and lower elements extend outward from the inner ends and are interconnected to the inner ends by a diagonally extending stabilizing element. The cross bar member is receivable in a rearwardly opening recess, and the upper element is receivable in a downwardly opening recess in an outwardly extending portion of the body. The diagonally extending stabilizing element is engageable with a downwardly extending portion of the body when the cross bar member and the upper element are received in the respective recesses, thereby securing the merchandise hanger against pivotal movement relative to the base portion, and yet allowing for repetitive removal and engagement of the hanger to the base portion when the base portion is mounted on the display panel.

32 Claims, 4 Drawing Sheets

U.S. PATENT DOCUMENTS 4,351,440 9/1982 Thalenfeld .
4,362,249 12/1982 Thalenfeld .
4,394,909 6/1983 Valiulis et al. .
4,405,051 9/1983 Thalenfeld .
4,436,209 3/1984 Thalenfeld .
4,452,360 6/1984 Barnes .
4,471,512 9/1984 Thalenfeld .
4,474,351 10/1985 Thalenfeld .
4,512,481 4/1985 Thalenfeld .
4,520,978 6/1985 Taub ..... 211/57.1 X
4,540,093 9/1985 Merl ..... 211/59.1
4,545,140 10/1985 Winston ..... 40/10 D
4,548,378 10/1985 Worrallo ..... 248/558
4,560,062 12/1985 Valiulis .
4,593,824 6/1986 Pfeifer .
4,606,466 8/1986 Fredrickson ..... 211/59.1
4,697,712 10/1987 Valiulis .

FIG.6
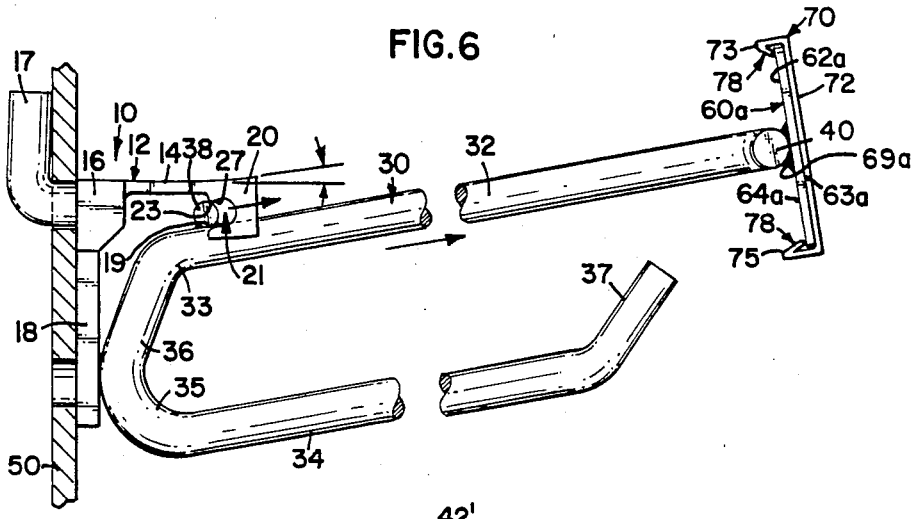
FIG.8
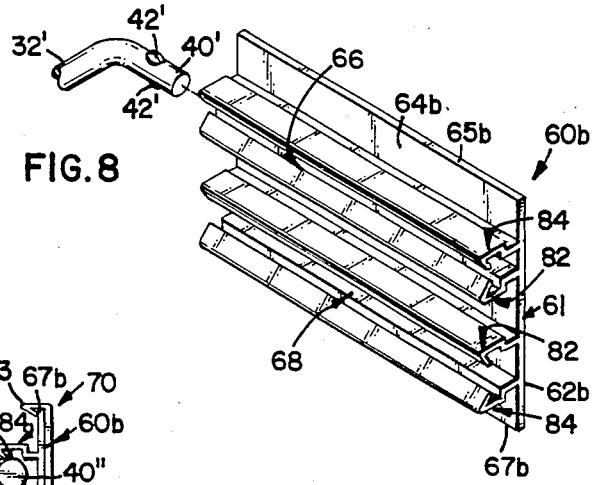
FIG.9
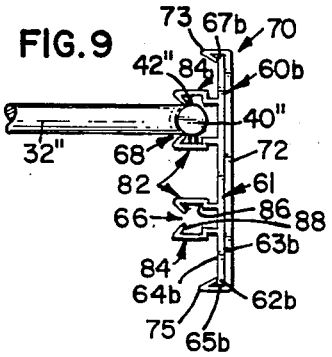
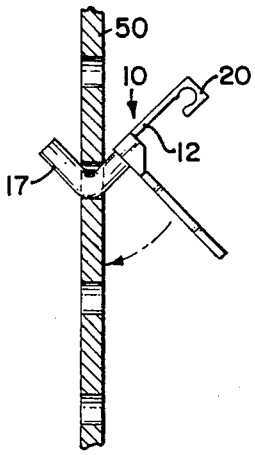
FIG.7

MERCHANDISE HANGER ASSEMBLY

BACKGROUND OF THE INVENTION

Merchandise display hangers adapted for insertion into apertured display panels, such as pegboard display panels, are widely used to display sales items in merchandise stores in the United States and abroad. Such display mechanisms allow an attractive, ordered, and efficient presentation of merchandise to customers. Efficiency results in part from the ease of changing the merchandise displayed, or the format for displaying the merchandise. If the format is to be changed, it is relatively straightforward to remove the display hangers from the apertured display panel. The hangers can then be remounted on the panel in a new format, given the spacing limitations of the holes in the display panel.

One such display hanger is disclosed, by Thalenfeld (U.S. Pat. No. 4,405,051). Thalenfeld discloses a wire-like merchandise display member having two interconnected outwardly projecting display arms. Wire-like lug means for mounting the display member on a pegboard display panel are attached to the portion interconnecting the two projecting arms. A display label can be attached to a label holder which attaches to the upper projecting arm, while the lower projecting arm is used to suspend the merchandise.

Display hangers such as the Thalenfeld device are used by merchandisers to present labeling information in an easily readable fashion. The information is displayed on the upper arm in front of the merchandise which is generally suspended from a lower arm. The label holding device must be readily accessible because of the need for frequent price and/or merchandise changes. At the same time, the device must be secure and sturdy so as to withstand frequent handling.

Where many sales items are displayed together on a single display panel or on a series of display panels, it is often difficult to remove a single display hanger or to add another without disrupting the hangers and/or merchandise which are already in place. The most common wire-like display hangers are similar to the Thalenfeld device in that they generally have relatively long supporting arms. When a device like the Thalenfeld device is closely surrounded by other similar devices, it is very difficult to insert or remove the Thalenfeld hanger because it must be tilted upwards into space often occupied by other hangers or merchandise supported by those hangers in order to insert the angular lug means into holes in the pegboard. Such disruptions tend to limit the efficiency the use of these devices affords.

It will be appreciated from the foregoing that prior art devices present problems which are in need of solutions. The present invention provides solutions for these and other problems.

SUMMARY OF THE INVENTION

In accordance with the present invention, a merchandise hanger assembly base portion for attachment to an upright, apertured merchandise display panel, and for receiving a merchandise display hanger having upper and lower elements interconnected at inner ends by a diagonally extending stabilizing element, and having a crossbar member located on a top side of the upper element and extending transversely thereof is provided. The merchandise hanger assembly base portion comprises an integrally molded, plastic body, and rearwardly and upwardly projecting L-shaped lug means for mounting the base portion on the apertured merchandise display panel. The body includes an outwardly extending portion interconnected at an inner end portion to a downwardly extending portion. The outwardly extending portion includes a bottom surface and an outer end portion defining a horizontally extending, rearwardly opening recess located below the bottom surface. The outer end portion also defines an outwardly extending, downwardly opening recess located at least partially below the rearwardly extending recess. The crossbar member is receivable in the rearwardly opening recess, and the upper element is receivable in the downwardly opening recess. The diagonally extending stabilizing element is engageable with the downwardly extending portion of the body when the crossbar member and the upper element are received in the respective recesses, thereby securing the merchandise hanger against pivotal movement relative to the base portion, and yet allowing for repetitive removal and engagement of the hanger to the base portion while the base portion is mounted on the display panel.

An alternate embodiment in accordance with the present invention provides a merchandise hanger assembly for attaching to an upright, apertured merchandise display panel. The merchandise hanger assembly comprises the base portion described hereinabove, and a merchandise display hanger. The merchandise display hanger includes upper and lower elements being spaced apart and having inner ends, and a crossbar member being located on a top side of the upper element and extending transversely thereof. The upper and lower elements extend outwardly from the inner ends and are interconnected at the inner ends by a diagonally extending stabilizing element. The crossbar member is receivable in the rearwardly opening recess and the upper element is receivable in the downwardly opening recess. The diagonally extending stabilizing element is engageable with the downwardly extending portion of the body when the crossbar member and the upper element are received in the respective recesses, thereby securing the merchandise hanger against pivotal movement relative to the base portion, and yet allowing for repetitive removal and engagement of the hanger to the base portion when the base portion is mounted on the display panel. Preferably, the rearwardly opening recess includes entry means for requiring an interference fit of the crossbar member.

Another embodiment of the present invention provides a scanner face plate for attachment to an end portion of a merchandise display hanger, the display hanger being engageable in an apertured display panel. The face plate comprises an integrally molded plastic body portion including an upright scanner face plate panel, and means for receiving the end portion of the merchandise display hanger. The means includes first and second receiving means for respectively receiving end portions of different hangers comprising wire having different diameters.

This allows the scanner face plate to attach to different merchandise display hangers so that they are more versatile. The respective receiving means are preferably situated such that the same plate may be received by different hangers side by side on the same display panel, such that the plate will appear to be at the same height on either hanger.

An advantage of the merchandise hanger assembly of the present invention is that the hanger assembly may be inserted in, or removed from a crowded apertured display panel without disrupting closely surrounding merchandise hangers or merchandise. The merchandise hanger assembly of the present invention provides a two piece assembly which can be easily inserted in a crowded display panel without disrupting other hangers and merchandise already in place. The base portion can be inserted first. Because it has a much shorter length than the entire assembly including the outwardly extending elements, the outer end portion of the base may be easily tilted upward to accommodate the insertion of L-shaped lug means in the apertured display panel without disrupting the surrounding hangers and merchandise. Once the base portion is mounted in the apertured display panel, the display hanger can be engaged by a simple pulling motion after aligning the crossbar with the rearwardly opening recess.

The present invention also provides for easy removal of the hanger assembly which can be accomplished without disrupting other hangers or merchandise on a crowded display panel. In this case, a pushing force is applied to the end portion of the upper element of the display hanger and directed along the length of the upper element so as to disengage the crossbar member from the rearwardly opening recess of the body. This can be accomplished with very little vertical variation, and no horizontal variation, from the space occupied by the hanger assembly. Once the hanger is removed, the base portion is then easily removed by tilting the relatively short outer end portion upwardly and simultaneously removing the L-shaped lugs from the apertures they occupy by pulling the base portion away from the display panel. Both of the aforementioned procedures can be substantially accomplished without disrupting surrounding hangers and merchandise.

An advantage of a preferred embodiment of the present invention which provides a base portion having relatively narrow thicknesses, is that the molding process may be accomplished faster. When the plastic is poured into the mold, it is an amorphous liquid having an elevated temperature. The molded base becomes rigid as the hot liquid plastic cools and becomes a solid. The narrower the thickness of the base portion, the faster the excess temperature can be dissipated. The preferred embodiment of the present invention attempts to minimize the thickness of the molded base portion in order to speed the molding process and to thereby allow the mold to be reused more often in any given period of time.

Preferably, a plastic material is used for molding which has strength and flexibility characteristics which will accommodate a base portion having minimal thicknesses while having enough strength to support the merchandise hanger and any merchandise it may be expected to support. The base portion of the present invention is preferably made of a hard plastic which exhibits good tensile strength and shape retention. This plastic will preferably be a thermoplastic which is solid at room temperature, but a flowable liquid at higher temperatures. Such materials include, but are not limited to, polyphenylene oxides, polystyrenes, polypropylenes, acetal copolymers, and the like. A preferred embodiment is made of a high impact polystyrene such as MX 5400 Super-High Impact Grade Polystyrene from Mobile Chemical Company (Paramus, N.J.). A more preferred embodiment is made of a polypropylene, preferably a polypropylene homopolymer (Type PP31S4A) produced by E1 Paso Products Co. (Odessa, Tex.). The most preferred is made of a polyphenylene oxide, preferably a white polymer plastic sold by the General Electric Company called Noryl TM thermoplastic resin (Type SE-100-701).

In accordance with another embodiment of the present invention, the upper element of the display hanger has a horizontally extending end portion which may be adapted to receive labeling means for displaying labeling information. This has become particularly desirable to merchandisers in order to be able to display bar codes for identifying products, so that inventories may be efficiently taken utilizing available computer driven technologies associated with the use of bar codes. A preferred embodiment of such a labeling means comprises a scanner face plate having an upright face plate panel and a means for receiving the horizontally extending end portion of the upper element of the display hanger. An alternate embodiment of the scanner face plate may be attached to the end portion by various means for attaching. Preferably, the scanner face plate panel is a metal stamping which is preferably welded to the end portion. An advantage of this embodiment is that the face plate does not need to be attached and it does not come apart unless the welding fails or is broken. This is very advantageous for merchandisers, because having fixedly attached face plates eliminates the need to replace face plates which are separated during the handling of merchandise by customers. Scanner face plates which are resistance welded, or spot welded, offer additional manufacturing advantages of offering an energy and cost efficient process, and a process which is less likely to warp the face plate because of the reduced heat required for spot welding.

Another advantage of the present invention is that the merchandise hanger assembly will release when a pushing force is placed on the end of the projecting arms, i.e. the upper and lower elements, to drive the hanger backwards in a pushing fashion. Such an event may occur when someone falls against the hangers. If the hanger is pushed directly toward the display panel, the crossbar member can be released from the rearwardly opening recess of the base portion, and the risk of injury caused by the outwardly extending arms will be thereby minimized because the arms will no longer resist the force pushing against them.

The above described features and advantages along with various other advantages and features of novelty are pointed out with particularity in the claims of the present application. However, for a better understanding of the invention, its advantages, and objects attained by its use, reference should be made to the drawings which form a further part of the present application and to the accompanying descriptive matter in which there is illustrated and described preferred embodiments of the invention.

BRIEF DESCRIPTION OF THE DRAWINGS

In the drawings, in which like reference numerals and letters indicate corresponding parts throughout the several views.

FIG. 6 is a cross-sectional view similar to FIG. 2 illustrating the crossbar member of the merchandise hanger of FIG. 1 during engagement in the rearwardly opening recess of the base, and illustrating a scanner face plate which is welded to the end portion of the upper element of the hanger;

FIG. 7 is a cross-sectional view similar to FIG. 2 illustrating the base portion of FIG. 1 being mounted on an apertured display panel;

FIG. 8 is a perspective view of a scanner face plate having mechanisms for receiving end portions of display hangers;

FIG. 9 is a side view of an end portion of a display hanger engaged in a scanner face plate.

DETAILED DESCRIPTION OF PREFERRED EMBODIMENTS OF THE INVENTION

Figure 1:
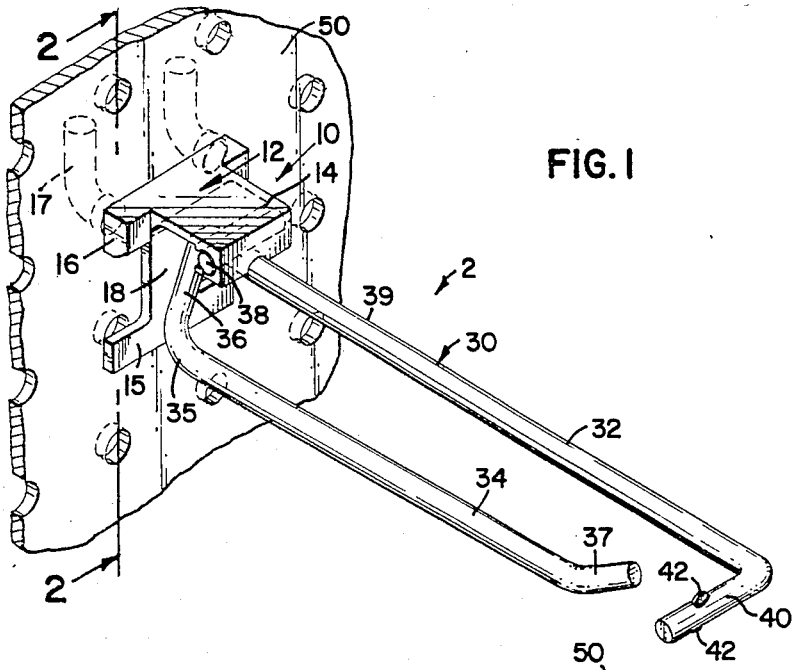
FIG. 1 is a perspective view of a merchandise hanger assembly of the preferred embodiment of the present invention mounted in an upright, apertured merchandise display panel.
Figure 2:
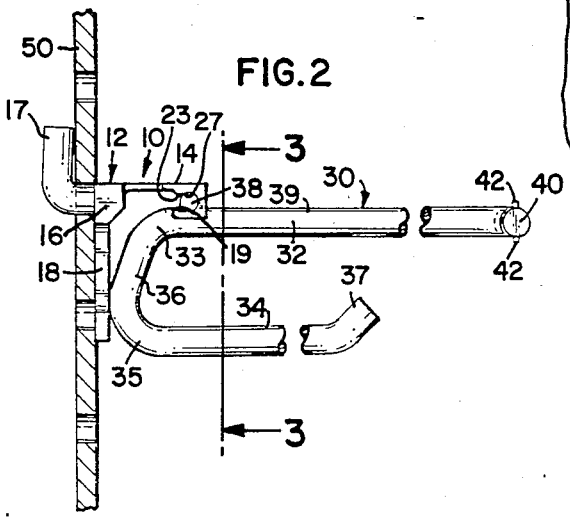
FIG. 2 is a cross-sectional view taken generally on line 2—2 of FIG. 1 illustrating the base portion and features of the merchandise display hanger shown in FIG. 1.
Figure 3:
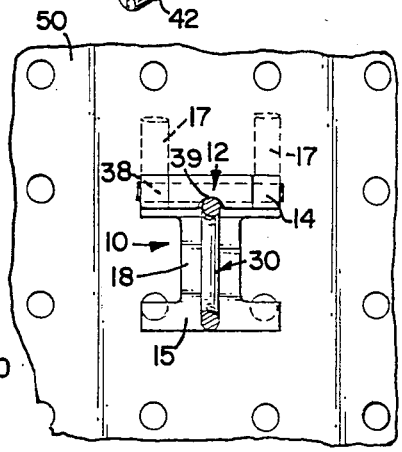
FIG. 3 is a front cross-sectional view along lines 3—3 of FIG. 2 illustrating the base portion and the relationship between the upper element of the merchandise hanger juxtaposed to the inner surface of the downwardly opening recess of the end portion of the body.

Referring to the drawings, and initially to FIGS. 1–3, the reference numeral 2 designates in a general way a merchandise display hanger assembly comprising a unitary base portion 10 and a merchandise display hanger 30. The base portion 10 comprises an integrally molded, plastic body 12 and rearwardly and upwardly projecting L-shaped lugs 17 for mounting the base portion on an apertured merchandise display panel 50.

Figure 5:
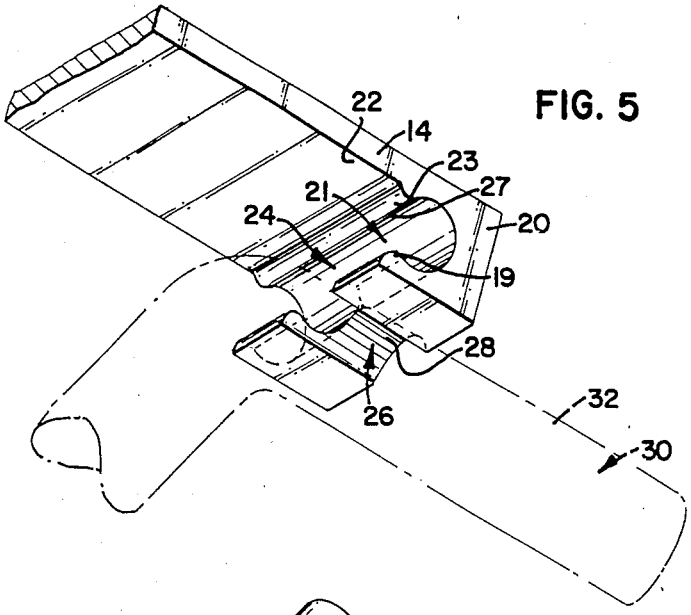
FIG. 5 is a perspective view of the outer end portion of the base portion in FIG. 4 illustrating the rearwardly opening recess and the outwardly extending downwardly opening recess.
Figure 4:
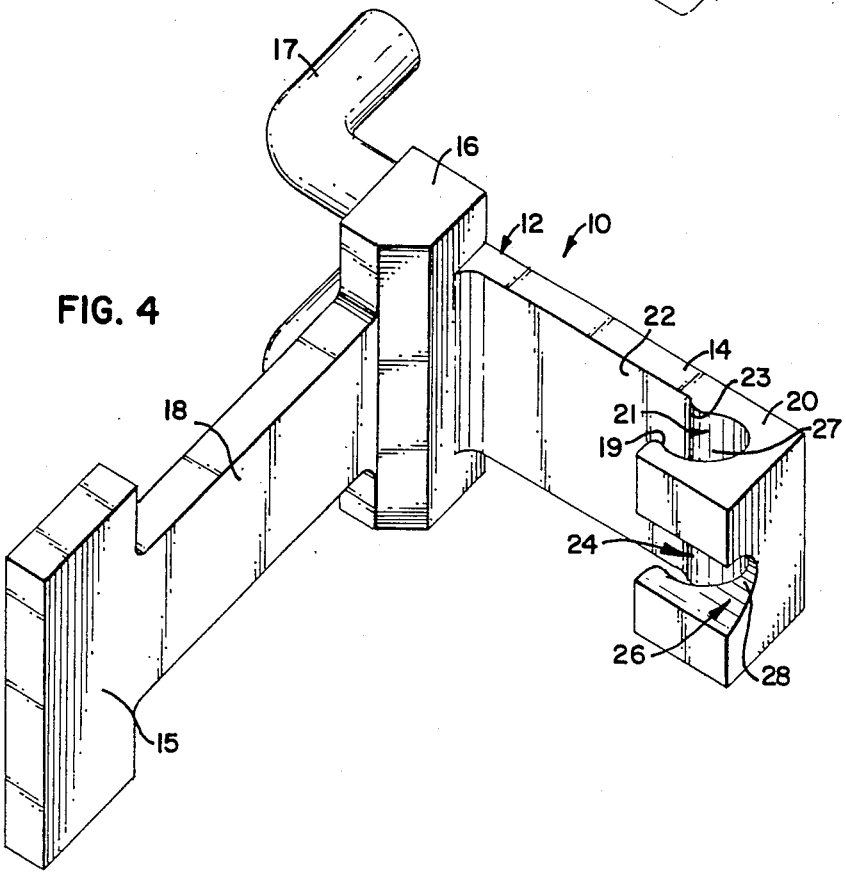
FIG. 4 is a perspective view of a base portion.

As reflected more particularly in FIG. 4, the base portion 10 comprises the L-shaped lugs 17 and a plastic body 12 including an outwardly extending portion 14 interconnected at an inner end portion 16 to a downwardly extending portion 18. Referring now particularly to FIGS. 4 and 5, the outwardly extending portion 14 includes an outer end portion 20 defining a horizontally extending, rearwardly opening, recess 21 disposed below a bottom surface 22 of the outwardly extending portion 14. The recess 21 further defines a transversely extending ridge 23 below the bottom surface 22 of the outwardly extending portion 14. The outer end portion 20 further defines an outwardly extending, downwardly opening recess 26 disposed at least partially below the rearwardly extending recess 21. The downwardly extending portion 18 of the body portion 12 comprises a downwardly extending T-shape 15.

Referring now to FIGS. 1 and 2, the merchandise hanger 30 of the hanger assembly 2 comprises an upper element 32 having an inner end 33, and a lower element 34 which also has an inner end 35. The upper and lower elements 32 and 34 extend outward from their respective inner ends 33 and 35 and are interconnected at their inner ends 33 and 35 by a diagonally extending stabilizing element 36. A crossbar member 38 is disposed on a top side 39 of the upper element 32 and extends transversely thereof. The crossbar member 38 is attached, preferably welded or soldered, to the upper element 32. This attachment is preferably accomplished by an automated or semi-automated process. The upper element 32 of the display hanger 30 has a horizontally extending end portion 40. Preferably, this end portion 40 has upwardly and downwardly extending nibs 42. These nibs 42 protrude beyond the adjacent surface of the end portion 40 of the upper element 32 so that they are able to provide support for subsequent attachments. They are created by an automated or semi-automated coining process which essentially pinches surfaces of the wire such that the nibs 42 are created. The lower element 34 of the display hanger preferably has an outwardly and upwardly extending end portion 37.

The upper and lower elements 32 and 34, and the interconnecting stabilizing element 36 of the display hanger 30 preferably comprise a metal wire made out of any suitable metal and having a substantially consistent diameter. Although virtually any size of wire can be used, the metal wire used in preferred embodiments preferably has a diameter selected from the group consisting of about 0.37 cm (0.147 inches), about 0.45 cm (0.177 inches), and about 0.57 cm (0.225 inches). The crossbar member 38 is preferably a relative short length of metal wire, about 2.5 cm (1 inch), or preferably about 2.2 cm (0.875 inches). In the preferred embodiment this wire has a diameter of about 0.37 cm (0.147 inches).

The body 12 is an integrally molded plastic structure. In alternate embodiments it may be either attached to the L-shaped lugs 17 by any known mechanical mechanism for attaching such structures, such as rivets, staples, and the like, or the L-shaped lugs 17 and the body 12 may be parts of a unitary, integrally molded plastic base portion 10. The plastic used to mold these structures may be made of any suitable hard plastic having some flexibility. Preferably this plastic will comprise any flexible, hard plastic which is suitable for molding prior to hardening. The hard plastic material is preferably selected from the group consisting of polystyrene, polypropylene, acetal copolymer, and the like. In a preferred embodiment, the hard plastic material is an RTP-800 series acetal copolymer from the RTP Co. (Winona, Minn.). In another preferred embodiment, the hard plastic material is a super-high impact polystyrene, preferably MX 5400 Super-High Impact Grade Polystyrene from the Mobile Chemical Co. (Paramus, N.J.). In a more preferred embodiment, the hard plastic material is a polypropylene homopolymer from El Paso Products Co. (Odessa, Tex.), preferably Type PP31S4A, an extrusion grade homopolymer. This product has excellent stability and uniformity for extended extrusion production runs.

The base portion 10 of the present invention has narrow thicknesses which accommodate rapid cooling of the hot plastic material once it is placed in the mold to make the molded plastic body of the present invention. The thicknesses of various parts of the molded plastic body are preferably less than about 1 cm. The narrowest portions of the body are preferably less than about 0.6 cm, more preferably less than about 0.35 cm and most preferably about 0.2 cm. These narrow thicknesses allow the plastic material, which is either poured or extruded into the mold, to harden in a shorter period of time than would otherwise be required for hardening if the thicknesses were greater.

In a preferred embodiment of the present invention, the base portion 10 has the following dimensions. The L-shaped lugs 17, which are substantially circular in cross-section, are about 0.4–0.6 cm, preferably about 0.5 cm in diameter. The cross-sectional dimensions of the inner end portion 16 are about 0.5–1.5 cm, preferably about 1 cm at most, and about 0.2–1.0 cm, prefably about 0.6 cm at least. The cross-sectional dimensions of the thicknesses of the outwardly extending portion 14 are about 0.5–1.5 cm, preferably about 1 cm at most, and about 0.1–0.5 cm, preferably about 0.2 cm at least. The cross-sectional dimension of the thickness of the downwardly extending portion 18 is about 0.1–0.5 cm, preferably about 0.25–0.35 cm. The length of the downwardly extending portion 18 is about 1.5–5.0 cm, preferably about 2.0–3.5 cm, most preferably about 2.5 cm. The length of the outwardly extending portion 14 is about 1.5–4.0 cm, preferably about 1.5–2.5 cm, most preferably about 1.75 cm. It will be appreciated, however, that the present invention may be made with virtually any dimensions so long as it is within the scope of the invention as defined in the claims which are made as a part of the present application.

Referring now to FIGS. 1–2 and 4–6, the outer end portion 20 defines a mechanism 24 for requiring an interference fit of the crossbar member 38 when the crossbar member 38 is engaged in the rearwardly opening recess 21. Preferably, the outer end portion 20 defines a transversely extending ridge 23 below a top surface 22 of the outwardly extending portion 14. This ridge 23 defines a rearward upper edge 27 of the rearwardly opening recess 21 such that the rearward upper edge 27 abutts against the transverse crossbar member 38 when the hanger 30 is fully engaged in the base portion 10 (see FIG. 2).

As shown in FIG. 5, when the hanger 30 is engaged in the outer end portion 20, the upper element 32 (shown in phantom) abutts against the inside surface 28 of the outwardly extending, downwardly opening recess 26. In FIG. 6, the crossbar member 38 is shown from the side just prior to being fully engaged in the rearwardly opening recess 21. As the hanger 30 is pulled outwardly away from the base portion 10 which is already mounted on an apertured display panel 50, the crossbar member 38 will snap into the rearwardly opening recess 21. In order for the crossbar member 38 to be engaged in the rearwardly opening recess 21, the outwardly extending portion 14 or the downwardly extending portion 18 must flex slightly away from the hanger 30 before returning substantially to its original position after the crossbar member 38 is engaged. Even when the crossbar member 38 is engaged, the outwardly extending portion 14 may remain slightly flexed or bent above a resting position when no hanger is engaged. The downwardly extending portion 18 may also remain slightly flexed or bent away from the hanger 30 when the hanger 30 is engaged. It is not possible for the crossbar member 38 to rotate or pivot with respect to the recess 21 or the base portion 10 when engaged therein.

Referring now to FIG. 2, when the hanger 30 is completely engaged in the base portion 10, the outwardly extending portion 14 can characteristically deviate slightly upwards from a substantially horizontal plane which it otherwise maintains. This will be especially evident when the base portion 10 is engaged in the apertured display panel 50, thereby preventing to a small degree the downwardly extending portion 18 from deviating from its substantially vertical plane. As shown in FIG. 2, the planes of the outwardly extending portion 14 and the downwardly extending portion 18 are substantially perpendicular to one another. Referring now to FIG. 2, as the hanger 30 and its crossbar member 38 are engaged in the base portion 10, the outwardly extending portion 14 and/or the downwardly extending portion 14 and/or the downwardly extending portion 18 must bend or flex slightly away from the hanger 30 in order to allow room for the hanger 30. Depending upon the placement of the crossbar member 38 upon the upper element 32, the outwardly extending portion 14 and the downwardly extending portion 18 may remain slightly bent or flexed away from the hanger 30, and away from their perpendicular relationship such that the angle between the planes of these two portions of the base portion 10 is slightly greater than a right angle. In no case, will the crossbar element be placed in such a position so that the hanger 30 does not abutt against the downwardly extending portion 18 when the hanger is engaged in the base portion 10. When the hanger 30 is thusly engaged, it cannot rotate or pivot on an axis about the crossbar member 38, either with respect to the recess 21, or with respect to the base portion 10.

The outer end portion 20 includes a mechanism 24 for requiring an interference fit of the crossbar member 38 in the rearwardly opening recess 21. An interference fit is a fit wherein the object fitting into the object which will hold it in place, displaces the holding object as it enters or leaves. When the hanger 30 is to be removed from the base portion 10, a force can be applied to the end portion 40 of the upper element 32 and directed along the length of the upper element 32 to force the crossbar member 38 out of the rearwardly opening recess 21. Because of the interference fit, it will take some force to move the crossbar member 38. The mechanism 24 for requiring an interference fit includes the transversely extending ridge 23 below the bottom surface 22 of the outwardly extending portion 14. This ridge 23 defines the rearward upper edge 27 of the rearwardly opening recess 21 such that the edge 27 abutts against the transverse crossbar member 38 when the hanger 30 is fully engaged in the recess 21. This is illustrated in FIG. 2, where the crossbar member 38 abutts against the rearward upper edge 27. When the hanger 30 is forced toward the lugs 17, and the crossbar member 38 is forced backwards and out of the recess 21, the outer end portion 20 must be slightly displaced so that the distance between the upper ridge 23 and a lower ridge 19 will be enlarged so that the crossbar member 38 can be removed from the recess 21. Referring now to FIG. 6, it will be appreciated that the distance between the upper ridge 23 and the lower ridge 19 must also be enlarged when the crossbar member 38 enters to become engaged in the recess 21.

One of the advantages of the merchandise display hanger assembly 2 of the present invention is that it can be engaged to or mounted upon the apertured display panel 50 without disrupting closely surrounding merchandise hangers or merchandise. When prior art merchandise hangers are mounted upon apertured display panels, the arm or arms which extend from the base of the prior art display hangers must be raised until it is nearly vertical or nearly parallel to the plane of the apertured display panel in order to insert the lugs into holes in the display panel. Therefore, the arms which extend outward from the lugs must pass through an angle of nearly 90° with respect to the horizontal position which the arms will eventually assume when the hanger is eventually engaged to or mounted upon the apertured display panel. In order to pass the outwardly extending arms through this 90° angle, it may be necessary to disrupt other hangers previously mounted on the apertured display panel, or merchandise which is attached to such hangers.

The present invention, however, does not require such disruption. Referring now to FIG. 7, the base portion 10 of the present invention may be mounted on the apertured display panel 50 prior to engagement of the merchandise display hanger 30. In such a case, the lugs 17 may be inserted and the base 10 mounted in the panel 50 without disrupting other hangers or merchandise, because of the relatively short length of the outwardly extending portion 14 of the base portion 10. Referring now to FIG. 7, since the outwardly extending portion will generally extend only about 4 cm., preferably about 2.5 cm from the point where the base of the lugs 17 are connected to the inner end portion 16. The outwardly extending portion 14 of the base portion 10 is extended upward in order to insert the lugs 17 into the display panel 50. It will be appreciated, therefore, that the length of the portion of the structure attached to the lugs 17 which must be passed through a 90° angle is quite short relative to the length of the outwardly extending arms which would normally need to be passed through this angle. Once the base portion 10 is mounted upon the apertured display panel 50, the hanger 30 may be engaged as shown in FIG. 6. In order to engage the hanger 30 in the base portion 10, it is not necessary to extend the outwardly extending elements 32 and 34 very far above the horizontal plane of the outwardly extending portion 14 of the base portion 10. Referring now to FIG. 6, it will be appreciated that even if the upper element 32 has a scanner face plate **60*a* attached to the outer end portion, the degree to which merchandise or hangers directly above the hanger 30 being engaged will be disrupted, will be much less than it would be with the single piece prior art merchandise hangers. It will be appreciated that this will enable the base portion 10 and the hanger 30** to be properly engaged, therefore, without disrupting nearly any nearby merchandise display hangers or the merchandise which hangs from those hangers.

Figure 10:
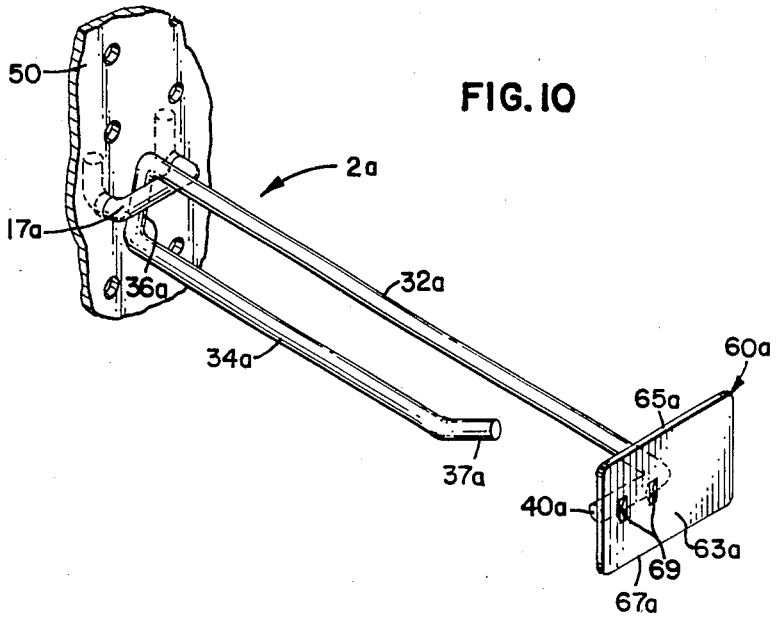
FIG. 10 is a perspective view of a one piece merchandise display hook having a flat metal scanner face plate welded to the end portion.

The present invention can include a device to display a label containing product information, preferably including bar code type information which aids merchandisers to efficiently inventory their merchandise. Referring now to FIG. 6, the present invention may include a simple metal scanner face plate **60*a* which can be fixedly attached, preferably welded or soldered, to the end portion 40 of the upper element 32. Such a scanner face plate 60*a* offers an advantage of being fixedly attached so that customers cannot remove them or knock them off so that employees would be required to replace them. The face plate 60*a* is made from a simple metal stamping with a substantially flat surface. The metal face plate 60*a* includes a face plate panel 62*a* having a front surface 63*a*, a rear surface 64*a*, and upper and lower edges 65*a* and 67*a*. The panel 62*a* may either receive a cover plate 70 to retain a label, or it may simply receive a label which is affixed to the front surface 63*a* of the panel 62*a* by any means known in the art. The front surface 63*a* of the upright face plate panel 62*a* is substantially flat with exception of two indentations 69 near the center of the left half or hemisphere of the panel 62*a* (as shown in FIG. 10). The face plate panel 62*a* and the metal stamping used to make the scanner face plate are identical and will both be designated by the reference numeral 62 and the letter a (e.g. 62*a***).

The metal stamping **62*a* used to make the metal scanner face plate 60*a* can be made by a blanking process which is preceeding by a coining type operation, wherein an indentation or indentations 69 are punched into a relatively soft metal, preferably having a relatively small percentage of carbon. The metal is then stamped out in the desired shape, preferably a rectangular shape. Each stamping preferably has two recesses or indentations 69 from the coining operation. These indentations 69 are roughly equally spaced and in the center of one half, or one hemisphere, of the stamping 62*a*. To weld the stamping 62*a* to the end portion 40*a* of a merchandise hanger 30, the protrusions 69*a* on the rear surface 64*a* of the stamping 62*a* which reciprocate the indentations 69 on the front surface 63*a* of the stamping 62*a* are held in contact with the end portion 40*a* of the hanger 30. The stamping 62*a* and the end portion 40*a* are then spot welded, or electrically resistance welded at the point of contact between the stamping 62*a* and the end portion 40*a*, using two welding electrodes to generate electric current between the front surface 63*a* and the end portion 40 such that the metal of these two elements fuses together at the point of contact. This method of attachment is extremely cost effective because it uses less energy than other welding procedures due to the limited area of contact between the panel 62*a* and the end portion 40*a*. Since there is a limited area of contact, less heat is required to be generated to fuse the metal. Therefore, the metal cools faster, and there is less chance that the metal will warp due to high temperatures. Additionally, this method is extremely fast, partially because of the small amount of energy required for spot welding, and partially because the weld cools so quickly due to the small amount of heat required. The indentations 69 which remain after the welding operation are important because they provide a recess for the area of the stamping 62*a* which melts and is fused with the end portion 40*a*. This area is generally rough. If the metal surface was flat at the point of contact where the metal fuses, the rough spot created there, which may be like a small protrusion or a blemish in the smooth metal surface 63*a* of the panel 62*a*, would need to be removed or it would provide a rough or irregular surface for affixing labels. Such a surface would be very undesirable from a merchandisers point of view for several reasons. First, the irregular surface would make it difficult to affix a label evenly to the plate 60*a*. Second, even if the label can be affixed, it may have an uneven or irregular surface which doesn't have a nice appearance. This irregular surface might even make it difficult to get a proper mechanical reading of the bar code information. On the other hand, a paper label can be easily affixed to the plate 60*a* over the indentation 69, without the indentation 69** showing when the label is affixed. It will be appreciated that the welding process described above also provides a very strong bond between the metal elements which are fused together.

An alternate embodiment of the present invention provides a metal scanner face plate **60*a* as described above. In yet another embodiment, a one-piece merchandise display hook 2*a* is provided which includes a metal scanner face plate 60*a* which is spot welded to the end portion 40*a*. Referring now to FIG. 10, a preferred embodiment of the one-piece merchandise display hook 2*a* provides many of the elements of the two piece merchandise display hanger assembly 2 described hereinabove. These elements are denoted by corresponding numerals having the additional letter reference "a". The metal scanner face plate is the same as described above and retains its designation of 60a. The one-piece merchandise display hook 2a has upper and lower elements 32a and 34a interconnected by a diagonally extending stabilizing elements 36a. The scanner face plate 60a is preferably spot welded to the end portion 40a which is horizontally extending. The hook 2a is mounted on the apertured display panel 50 with an L-shaped lug mechanism 17a which is preferably joined to the stabilizing element 36a** by a welding process.

An alternate embodiment provides for a scanner face plate 60b which can be detachably engaged to the end portion 40 of the upper element 32 of the hanger 30. Such a scanner face plate 60b is illustrated in FIGS. 8 and 9 where the primed and double primed reference numerals refer to elements which correspond to elements previously described and having the same reference numerals, but which designate these elements on embodiments which have differing cross-sectional diameters. The scanner face plate 60b may or may not have a cover plate 70 in the same manner as the metal scanner face plate 60a. The preferred embodiment of the detachable scanner face plate 60b can be attached to more than one size display hanger 30. This face plate 60b is adapted for attachment to a wire end portion 40 of either a merchandise display hanger 30 which is to be engaged in a base portion 10 for engagement in an apertured display panel 50, or a similar merchandise display hanger which may be directly engaged in an apertured display panel.

The face plate 60b comprises an integrally molded plastic body portion 61b including an upright scanner face plate panel 62b, a first mechanism 66 for receiving an end portion 40' having an unspecified specific diameter, and a second mechanism 68 for receiving an end portion 40" having a different specific diameter. The face plate panel 62b includes a front surface 63b and a rear surface 64b, an upper edge 65b and a lower edge 67b. Preferably, the upper edge 65b and the lower edge 67b are horizontally extending edges as shown, although they need not be so. As illustrated in FIGS. 8 and 9, if two merchandise hangers 30 having different end portions 40' and 40", which have different cross-sectional diameters, are mounted on an apertured display panel 50 at the same height, a scanner face plate 60b engaged to the first end portion 50' by the first receiving mechanism 66, may be removed from the first end portion 40', turned 180° on the plane of the face plate panel 62b and engaged to the second end portion 50" with the second receiving mechanism 68 such that the lower edge 67b is now on the top and it extends upwards to substantially the same height with respect to the hanger 30, and the display panel 50, as the upper edge 65b extended when the scanner face plate 60b was engaged to the first end portion 40'.

The scanner face plate 60b of the present invention is preferably covered with a cover plate 70. The cover plate 70 is preferably integrally molded out of a translucent plastic and includes an upright, flat panel 72 having an upper lip 73 and a lower lip 75. The cover plate comprises a mechanism 78 for slidably receiving either the metal scanner face plate 60a (as shown in FIG. 6), or the upright panel 62 of the face plate 60b, shown in FIGS. 8 and 9, on the upper and lower lips 73 and 75 such that said mechanism 78 engages the upper and lower edges 65 and 67 of the face plate panel 62 when the cover plate 70 is engaged to the face plate 60b.

The first and second receiving mechanisms 66 and 68 each include inner and outer retention slots 82 and 84 which are spaced apart differently to accommodate the reception of different end portions 40' and 40" having different cross-sectional diameters. Each of the retention slots 82 and 84 included inner and outer retention lips 86 and 88. The retention slots 82 and 84 cooperate to receive and retain end portions 40. The retention lips 86 and 88 cooperate with the nibs 42 to substantially prevent the scanner face plate 60b from rotating axially on the end portion 40.

The plastic used to make the scanner face plate and the cover plate may include any suitable plastic which is known in the art. Preferably, a polypropylene, a polystyrene, an acetal copolymer, or the like is used to make these molded devices.

Embodiments of the present invention will be described by reference to the following example.

EXAMPLE

Metal stampings 62a are made by first punching a series of regularly spaced indentations 69 into a relatively soft sheet of steel having a thickness of about 0.1 cm (0.042 inches) and having a carbon content of less than 0.1%. Metal stampings 62a are then stamped out by a blanking process which makes substantially rectangular steel stampings which are about 5 by about 3.5 cm (2.0×1.4 inches). The corners of the rectangle are rounded with a 0.3175 cm (0.125 inch) radius. Each metal stamping 62a has two indentations 69 in the front surface 63a which create reciprocal protrusions 69a on the rear surface 64a. The indentations 69 are spaced 0.95 cm (0.375 inches) apart and are centered equidistant from the edges 65a and 67a with respect to the 3.5 cm dimension, and in one side, or one half, of the rectangular stamping 62a used to make the metal scanner face plate 60a in FIG. 10. The indentations 69 are punched with a punch having a rectangular contact which is 0.635 by 0.08 cm (0.25×0.03125 inches).

The metal stamping 62a is spot welded to the end portion 40a in the one-piece merchandise display hook 2a shown in FIG. 10 which includes the resulting metal scanner face plate 60a. Flat metal electrodes are used to hold the metal stamping 62a against the end portion 40a of the merchandise display hook 2a such that the end portion 40a only contacts the center of the protrusions 69a which are created by the indentations 69. One electrode contacts the front surface 63a of the stamping 62a having the indentations 69, and the other contacts the end portion 40a such that the electrodes sandwich the elements and hold them together. The stamping 62a is then spot welded, or electrically resistence welded, to the end portion 40a at a setting of 5 volts, with 90% heat and 10 cycles of current (10 cycles at 60 cycles per second or one-sixth of a second), thereby generating 14,600 amps of current and consuming approximately 3 watts of power. Because the current is directed to the contact points, the resistence is greatest at these points of contact and the metal at these points melts, and fuses together. The heat generated is not great enough to warp the scanner face plate 60a and its front surface 63a is left with a substantially smooth and unblemished plane with the two indentations 69 being the only deviations from this plane. Gummed labels carrying consumer and/or bar code type information are easily rolled or otherwise affixed to this surface 63a.

While certain representative embodiments of the present invention have been described herein for the purposes of illustration, it will be apparent to those skilled in the art that modifications therein may be made without departing from the spirit and scope of the present invention.

What is claimed is:

1. A merchandise hanger assembly base portion for attachment to an upright, apertured merchandise display panel, and for receiving a merchandise display hanger having upper and lower elements interconnected at inner ends by a diagonally extending stabilizing element, and having a crossbar member located on a top side of the upper element and extending transversely thereof, said assembly base portion comprising:

(a) an integrally molded, plastic body, the body including an outwardly extending portion interconnected at an inner end portion to a downwardly extending portion, the outwardly extending portion including a bottom surface and an outer end portion defining a horizontally extending, rearwardly opening recess located below said bottom surface, said outer end portion also defining an outwardly extending, downwardly opening recess located at least partially below the rearwardly extending recess; and (b) rearwardly and upwardly projecting L-shaped lug means for mounting said base portion on the apertured merchandise display panel;

wherein the crossbar member is receivable in said rearwardly opening recess, and the upper element is receivable in the downwardly opening recess, wherein the diagonally extending stabilizing element is engageable with said downwardly extending portion of said body when the crossbar member and the upper element are received in the respective recesses, thereby securing the merchandise hanger against pivotal movement relative to said base portion and yet allowing for repetitive removal and engagement of the hanger to said base portion while said base portion is mounted on the display panel.

2. The merchandise hanger assembly base portion according to claim 1, the rearwardly opening recess including entry means for requiring an interference fit of the crossbar member.

3. The merchandise hanger assembly base portion according to claim 2, said entry means having a horizontal opening for receiving the crossbar member, said opening being smaller than the diameter of the crossbar member.

4. The merchandise hanger assembly base portion according to claim 3, said entry means having an upper ridge and a lower ridge, said upper ridge extending transversely of said outwardly extending portion and downwardly from said bottom surface, said lower ridge located opposite to said upper ridge and defining a lower surface of said horizontal opening, said upper ridge and said lower ridge cooperating to require an interference fit of the crossbar member wherein said upper ridge or lower ridge must be displaced to allow the crossbar member to pass through said opening, said opening being smaller than the diameter of the crossbar member.

5. The merchandise hanger assembly base portion according to claim 1, the downwardly opening recess communicating with the rearwardly extending recess.

6. The merchandise hanger assembly base portion according to claim 1, said integrally molded, plastic body consisting essentially of a hard plastic selected from the group consisting of polypropylenes, polystyrenes, and acetal copolymers.

7. The merchandise hanger assembly base portion according to claim 6, said integrally molded plastic body consisting essentially of polypropylene.

8. The merchandise hanger assembly base portion according to claim 1, the base portion being an integrally molded unitary structure.

9. The merchandise hanger assembly base portion according to claim 8, the inner end portion of the body having a rear surface, the lug means including two L-shaped lugs interconnected to the said rear surface of the inner end portion of the body.

10. A merchandise hanger assembly for attachment to an upright, apertured merchandise display panel, said hanger assembly comprising:

(a) a base portion including:

(i) an integrally molded, plastic body, said body including an outwardly extending portion interconnected at an inner end portion to a downwardly extending portion, the outwardly extending portion including a bottom surface and an outer end portion defining a horizontally extending, rearwardly opening recess located below said bottom surface, said outer end portion also defining an outwardly extending, downwardly opening recess, located at least partially below the rearwardly extending recess; and (ii) rearwardly and upwardly projecting L-shaped lug means for mounting on the apertured merchandise display panel; and (b) a merchandise display hanger including:

(i) upper and lower elements being spaced apart and having inner ends, said upper and lower elements extending outward from said inner ends and being interconnected at said inner ends by a diagonally extending stabilizing element; and (ii) a crossbar member being located on a top side of the upper element and extending transversely thereof, said crossbar member being receivable in said rearwardly opening recess and said upper element being receivable in said downwardly opening recess, said diagonally extending stabilizing element being engageable with the downwardly extending portion of the body when the crossbar member and the upper element are received in the respective recesses, thereby securing the merchandise hanger against pivotal movement relative to the base portion and yet allowing for repetitive removal and engagement of said hanger to said base portion when said base portion is mounted on the display panel.

11. The merchandise hanger assembly according to claim 10, the rearwardly opening recess including entry means for requiring an interference fit of the crossbar member.

12. The merchandise hanger assembly according to claim 11, said entry means having a horizontal opening for receiving the crossbar member, said opening being smaller than the diameter of the crossbar member.

13. The merchandise hanger assembly according to claim 10, said entry means having an upper ridge and a lower ridge, said upper ridge extending transversely of said outwardly extending portion and downwardly from said bottom surface, said lower ridge located opposite to said upper ridge and defining a lower surface of said horizontal opening, said upper ridge and said lower ridge cooperating to require an interference fit of the crossbar member wherein said upper ridge or lower ridge must be displaced to allow the crossbar member to pass through said opening, said opening being smaller than the diameter of the crossbar member.

14. The merchandise hanger assembly according to claim 10, the downwardly opening recess communicating with the rearwardly extending recess.

15. The merchandise hanger assembly according to claim 14, said integrally molded, plastic body consisting essentially of a hard plastic selected from the group consisting of polyphenylene oxides, polypropylenes, polystyrenes, and acetal copolymers.

16. The merchandise hanger assembly according to claim 10, said integrally molded plastic body consisting essentially of polyphenylene oxide.

17. The merchandise hanger assembly according to claim 16, the base portion being an integrally molded unitary structure.

18. The merchandise hanger assembly according to claim 10, the upper element of the display hanger including a horizontally extending end portion.

19. The merchandise hanger assembly according to claim 18, the horizontally extending end portion of the upper element of the display hanger including upwardly and downwardly extending nibs, wherein the nibs protrude beyond the adjacent surface of the end portion of the upper element.

20. The merchandise hanger assembly according to claim 18, the display hanger including an upright scanner face plate attached to said horizontally extending end portion.

21. The merchandise hanger assembly according to claim 20, the display hanger including a cover plate for covering said scanner face plate, said face plate having at least two edges, said receiving at least two edges of said face plate when engaged therewith.

22. The merchandise hanger assembly according to claim 10, said lower element including an outwardly and upwardly extending end portion.

23. The merchandise hanger assembly according to claim 10, further comprising a scanner face plate having an upright face plate panel and means for receiving the horizontally extending end portion of the upper element of the display hanger.

24. The merchandise hanger assembly according to claim 23, said means including first and second receiving means for receiving said horizontally extending end portion, said first and second receiving means having first and second receiving openings respectively, said first and second receiving openings respectively having different sizes to respectively receive end portions of different display hangers comprising wire having different diameters, said face plate panel having a rear surface and at least two edges, said edges being opposite one another, said first and second receiving means being located on the rear surface of the face plate panel such that when the first and second receiving means are alternately engaged to end portions of hangers comprising wire having different diameters, said end portions being engaged in base portions attached to the apertured display panel at the same height, one of the edges of the face plate panel will extend upward to substantially the same height with respect to the apertured display panel as the opposite edge extends when the face plate panel is turned 180° on the plane of the face plate panel and the second receiving means is engaged to the end portion of the other hanger.

25. A scanner face plate for attachment to an end portion of a merchandise display hanger, said display hanger being engageable in an apertured display panel and having an end portion including a wire having a diameter, said face plate comprising:

(a) an integrally molded plastic body portion including:

(i) an upright scanner face plate panel, said panel having a rear surface and at least two edges, said edges being opposite one another;

(ii) means for receiving the end portion of the merchandise display hanger; said means including first and second receiving means for respectively receiving end portions of different hangers comprising wire having different diameters, said first and second receiving means being located on said rear surface such that when the first and second receiving means are alternately engaged to alternate end portions of hangers engaged at the same height with respect to the apertured display panel and having different diameters, one of the edges of the face plate panel will extend upwardly to substantially the same height with respect to the apertured display panel as the opposite edge extends when the face plate panel is turned 180° and the alternate receiving means is engaged to the end portion of the other hanger.

26. The scanner face plate of claim 25, the upright scanner face plate panel having an upper and a lower horizontally extending edge.

27. The scanner face plate of claim 25, including a cover plate comprising an integrally molded, translucent plastic body including an upright flat panel having attaching means for slidably receiving the upright panel of the face plate, said attaching means including upper and lower lips such that said lips engage the upper and lower edges of the face plate when the cover plate is engaged to the face plate.

28. A scanner face plate for attachment to a horizontally extending end portion of a merchandise display hook by resistance welding, and for receiving labels to be attached thereon, said scanner face plate comprising a substantially flat metal panel having a front surface and a rear surface, said front surface including indentation means, said indentation means including a recess in the front surface reciprocated by a protrusion in the rear surface, said protrusion being fused to the end portion by a process of resistence welding such that any disruption of the front surface caused by heat from the welding process is located in to said indentation means.

29. A merchandise display hook for attachment to an upright apertured merchandise display panel, comprising an outwardly extending upper element having a horizontally extending outer end portion, L-shaped lug means for mounting said display hook on the apertured display panel, and a metal scanner face plate which is welded to the outer end portion of the outwardly extending upper element, said metal scanner face plate including a front surface and rear surface, indentation means in said front surface and protrusion means in said rear surface reciprocating said indentation means, said indentation means including a recess in said front surface reciprocated by a protrusion in said rear surface, said protrusion being fused to said outer end portion.

30. The merchandise display hook of claim 29, said display hook further comprising an outwardly extending lower element having an upwardly and outwardly extending outer end portion, said upper and lower elements interconnected at inner ends by a diagonally extending stabilizing element, said lug means including a U-shaped lug element including two L-shaped lugs, said lug element being welded to said stabilizing element.

31. The merchandise display hook of claim 29, said recesses means including a plurality of indentations, said protrusion means including a plurality of protrusions which reciprocate said recesses, wherein said protrusions are fused to said outer end portion.

32. The scanner face plate of claim 28, said indentation means including a plurality of recesses, said recesses being reciprocated by a plurality of protrusions on said rear surface, wherein said protrusions are fused to the outer end portion.

* * * * *